United States Patent [19]

Walter et al.

[11] Patent Number: 4,759,905

[45] Date of Patent: Jul. 26, 1988

[54] METHOD FOR FABRICATION OF LOW COST FINELY DIVIDED SILICON-GERMANIUM AND CONSOLIDATED COMPACTS THEREOF

[75] Inventors: John L. Walter, Scotia; Ami E. Berkowitz, Schenectady, both of N.Y.

[73] Assignee: General Electric Company, Schenectady, N.Y.

[21] Appl. No.: 33,953

[22] Filed: Apr. 3, 1987

Related U.S. Application Data

[63] Continuation of Ser. No. 911,856, Sep. 26, 1986, abandoned.

[51] Int. Cl.[1] ..... B22F 3/24

[52] U.S. Cl. ..... 419/23; 136/239; 252/62.3 T; 264/6; 264/10; 264/157; 75/228; 419/28; 419/33; 419/62; 419/66

[58] Field of Search ..... 75/228; 136/239; 252/62.3 T; 264/6, 10, 157; 419/23, 28, 33, 62, 66

[56] References Cited

U.S. PATENT DOCUMENTS

| | | | |
|---|---|---|---|
| 3,355,279 | 11/1967 | Ishibashi | 75/0.5 |
| 3,898,080 | 6/1975 | Penn | 252/62.30 T |
| 3,899,359 | 8/1975 | Starchurski | 136/205 |
| 4,061,505 | 12/1977 | Hamysl | 252/62.30 T |

OTHER PUBLICATIONS

J. E. Greene & J. L. Guerrero-Alvarez, "Electro--Erosin of Metal Surfaces", Metallurgical Transaction, 5, (Mar. 1974), pp. 695-706.

E. W. Gray & J. R. Pharney, "Electrode Erosion by Particle Ejection in Low-Current Arcs", Journal of Applied Physics, 45, #2, (Feb. 1974), pp. 667-670.

F. Van Dijck & R. Snoeys, "A Theoretical & Experimental Study of the Main Parameters Governing the Electro-Discharge Machining Process", Mecanique Nos. 301-302—Janvier-Fevrier, (1975), pp. 9-16.

S. Aur, T. Egami, A. E. Berkowitz & J. L. Walter, "Atomic Structure of Amorphous Particles Produced by Spark Erosion", The American Physical Society, vol. 26, #12, (Dec. 15, 1982), pp. 6355-6361.

A. E. Berkowitz, J. D. Livingston & J. L. Walter, "Properties of Mn-Al-C Magnets Prepared by Spark Erosion & Other Rapid Solidification Techniques", J. Appl. Phys., 55, (6), (Mar. 15, 1984), pp. 2106-2108.

A. E. Berkowitz, J. D. Livingston & J. L. Walter, "Properties of Mn-Al-C Magnets Prepared by Spark Erosion & Other Rapid Solidification Techniques", General Electric Company Technical Information Series, #83CRD303, (Dec. 1983), pp. 1-4.

A. E. Berkowitz & J. L. Walter, "Amorphous Particles Produced by Spark Erosion", General Electric Company Technical Information Series, #82CRD030, (Feb. 1982), pp. 1-12.

W. Ishibashi, "Reaction Between Powder and Liquid Medium at Spark Discharge Points", Powder and Powder Metallurgy, vol. 24, No. 4, 1977, p. 107.

W. Ishibashi, "Production of Fine Powder by Spark Discharge", Powder and Powder Metallurgy, vol. 24, No. 4, 1977, p. 107.

*Primary Examiner*—Stephen J. Lechert, Jr.

*Attorney, Agent, or Firm*—Paul E. Rochford; James C. Davis, Jr.; Paul R. Webb, II

[57] ABSTRACT

Apparatus is provided for the production of ultrafine powder. The powder is produced by spark erosion within an electric discharge cell. The starting material for production of the powder is a body in chunk form of the material to be pulverized. The material is contained in an electric discharge cell having a fine mesh screen bottom. The cell and its contents are immersed in a dielectric fluid such as water, liquified gas or an organic base liquid. The cell and its contents are vibrated to cause the chunks to separate repeatedly and momentarily. A sparking voltage is impressed repeatedly through the body to develop sparks between confronting portions of separated chunk surfaces. Small particles produced as a result of the sparking fall through the screen of the cell and are collected as product.

4 Claims, 6 Drawing Sheets

28
30
32
36
34
14
16
18
78
81
10
82
74
76
84
96
20
94
86
84
12
50
38
40
60
44
42
80
72
55
52
70
26
90
56
54
24
92
22

METHOD FOR FABRICATION OF LOW COST FINELY DIVIDED SILICON-GERMANIUM AND CONSOLIDATED COMPACTS THEREOF

This application is a continuation of application Ser. No. 911,856, filed Sept. 26, 1986, now abandoned.

BACKGROUND OF THE INVENTION

The present invention relates generally to formation of finely divided powder at low cost.

More particularly, it relates to apparatus and methods for formation of particles having particle sizes generally in the range of 25A to 40μ or larger. The invention is useful in forming fine particles from high melting materials. By high melting materials is meant materials which melt at temperatures of about 600° C. and above. However, the method also has unique application to materials of lower melting point. For example, it is very difficult to form fine particles of 25A to 40μ from some lower melting materials, such as cadmium, which melts at about 321° C. However, the present invention can successfully accomplish this. It has great value for materials of higher melting point because of the great difficulty of reducing certain higher melting materials such as refractory metals and superalloys to finely divided form.

Very finely divided particles of high melting metals are needed for many applications. Until now, it has been difficult and costly to produce such very fine particles. One reason is that only a small percentage of very fine or ultrafine particles are formed in conventional processing of material into finely divided form. Conventional atomization by flowing gas may produce less than ten percent and in some cases less than two percent of particles in the range of less than 10 microns. When this is the case, fifty pounds of material must be atomized to produce one pound of ultrafine powder. The need to process large amounts of material to obtain the ultrafine fraction raises the cost of the ultrafine material which is collected and then separated from the coarser powder. Ultrafine powder is defined herein as powder having an average particle size of less than 10 microns, that is, a powder in which the more than half of the weight of the material is of a particle size of less than 10 microns.

Another problem in the production of ultrafine powder by conventional means, as by gas atomization, is that the finest particles tend to cling to larger particles. A particle of 50 Angstroms may cling tenaciously to a particle of 100 microns so that when the material is screened the ultrafine particle is collected with the larger particles rather than with the finer particles. This tendency of the finer to cling to larger particles further raises the cost of the ultrafine product.

For these and similar reasons the cost of ultrafine powder, depending on the nature of the material, may be hundreds or even thousands of dollars per pound.

BRIEF STATEMENT OF THE INVENTION

One object of the present invention is to provide a method by which very finely divided silicon-germanium powder may be formed from solid materials.

Another object is to provide an ultrafine silicon-germanium powder having more highly homogeneous content of ingredients.

Another object is to provide a low cost powder of ultrafine particle size and uniform content of its silicon-germanium melting ingredients.

Another object is to provide a method of forming various silicon-germanium compositions and articles the particles of which contain more homogeneous atomic percentages of constituent elements.

Other objects will be in part apparent and in part pointed out in the description which follows:

In one of its broader aspects, these and other objects can be achieved by disposing a charge of chunks of silicon-germanium into a liquid dielectric, providing means for intermittently separating the chunks of said charge, and applying a voltage to said charge to cause electric discharge in said gaps and removal of material from said chunks.

In one of its aspects the objects may be achieved by forming a very fine silicon-germanium powder by spark erosion of a bed of chunks of a starting material immersed in a dielectric fluid. The powder may be consolidated to form new thermoelectric devices.

One way in which this may be accomplished is by placing a charge of chunks of starting material within an insulating basket which has an insulating screen floor. The screen may be of a mesh size finer than that of the chunks and larger than that of the product particles to pass therethrough. Two electrode bars may be disposed on opposite sides of the charge within the basket to position the charge of chunks therebetween. Where it is desired, the electrodes may be formed of or be coated with the material of the chunks. A container may surround the basket and contains a dielectric fluid. The dielectric fluid can conveniently fill a collection reservoir beneath the basket as well as the basket so that the chunks and electrodes are fully immersed in the fluid. The electrodes may then be electrically charged. The electric power supply means may include a condenser and means for charging the condenser.

Leads from such power supply may extend through the container walls to deliver electric sparking power released by discharge of the condenser to the electrodes and through the chunks from one electrode to the other. The condenser may be repeatedly charged and discharged at rates which may be many times per second. The basket and its contents may be vibrated to cause the chunks to separate intermittently and to cause intermittent separation of the chunks from the electrodes so as to form a number of gaps between various chunks at the time a capacitor is discharged. By proper agitation of the chunks between the electrodes in the basket as the condenser is repeatedly discharged, sparks may be induced across the gaps as well as across gaps between the chunks and the electrodes. Because the basket and its contents are immersed in dielectric fluid, the gaps are filled with dielectric at the time the sparks are struck.

BRIEF DESCRIPTION OF THE DRAWINGS

The present invention will be understood with greater clarity from the description which follows if reference is made to the accompanying drawings in which.

DETAILED DESCRIPTION OF THE INVENTION

Figure 1:
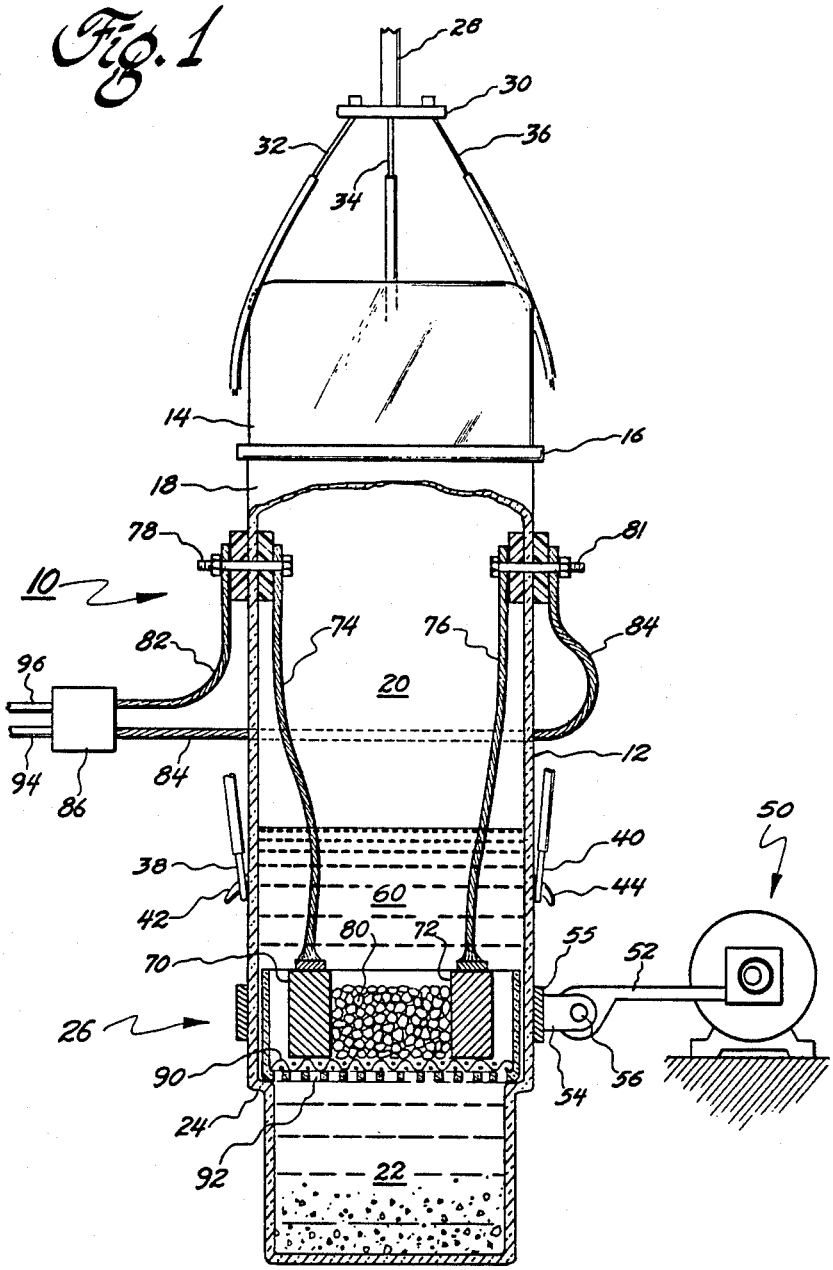
FIG. 1 is a semischematic perspective view of an apparatus in which spark erosion preparation of an ultrafine powder may be accomplished.

In order to have a better understanding of the invention, some brief discussion is given first of what the invention is not. The invention is not a means for electric discharge machining abbreviated in the trade as EDM. The technology of electric discharge machining is well developed and well known. According to this technology, a workpiece of some metal which is to be machined is provided. For example, the workpiece may be the blade of a turbine or jet engine into which coolant passages are to be machined by the electric discharge machining process. The workpiece may be a solid metal casting, for example. The workpiece is made one electrode of the electric discharge machining system and a tool is made the other electrode. By careful adjustment of the spacing between the end of the tool and the workpiece, a discharge can be made to occur which eats away metal from the workpiece and forms the machined surface. The object of this machining is to accomplish an alteration of the workpiece and the thing of value which is produced is the workpiece which has been subjected to the machining. The subject invention has nothing to do with the provision of workpieces which are to be given preselected shapes and forms which render such workpieces of greater value.

In fact, in the practice of the subject invention, there is no tool and there is no workpiece and there is particularly no workpiece which is increased in value by being shaped or formed or hollowed out by an electric discharge mechanism.

In fact, surprisingly, the present invention relies on a phenomena which in essence contradicts the technology commonly known as electric discharge machining. It contradicts the technology in starting with random chunks of material as input ingredients and subjecting them to processing according to the present invention to form a very finely divided powder and to convert the chunks into smaller chunks of material of equally random configuration and surface.

Further, the subject process is a contradiction of the electric discharge machining in that there is no tool which is employed or used in the process, but rather the chunks of material are held together in a charge so that any part of any chunk may interact with any part of any other chunk during the processing according to a purely random agitational phenomena.

Further, the subject process is a contradiction of the electric discharge machining technology in that the important and valuable product of the invention and the result of the processing is a very finely divided material which may be controlled as to size and distribution of size and content and surface composition. This is a contradiction of the electric discharge machining processing in that any material which is removed in the EDM process is waste and discarded as waste without any concern for the composition or size distribution of the waste product of the prior art processing.

Remarkably, what we have found is that if random chunks, that is random as to size and shape are placed as a charge between electrodes and are immersed within a dielectric fluid and are agitated, then the passage of an electric discharge current through the charge will cause the formation of fine particles which are highly valuable. We know very well that the production of the valuable fine powder can be accomplished in the manner just outlined. However, we are not quite sure precisely what mechanism is involved in the processing which does take place.

However, in order to provide a fuller explanation of the basis of our invention and to permit those skilled in the art to make greater use of the invention, an explanation of the mechanism is provided here on the basis that the accuracy and validity of the invention which is claimed is not to be understood to be dependent on the accuracy and validity of the explanation of the mechanism which is given here.

Figure 3:
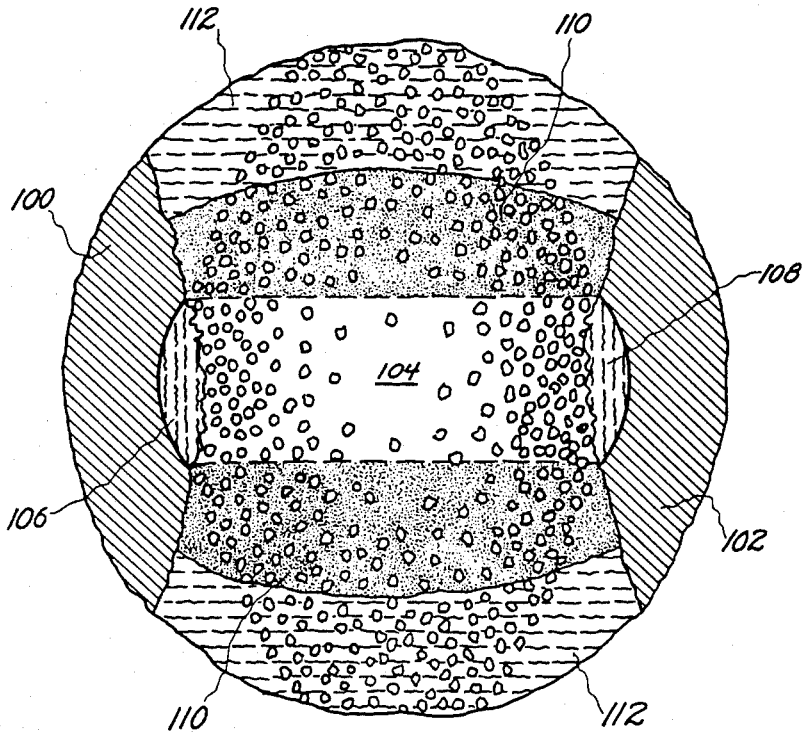
FIG. 3 is a schematic conceptual illustration of the type of phenomena which may occur as a spark or brief arc is established between two chunks of the raw material in the bath.

For purpose of explanation, reference is made first to FIG. 3. In making this explanation, it will be understood that the environment for the phenomena which is described and discussed is one in which there are a number of chunks of material having the required level of resistivity disposed in a dielectric medium such as a liquid hydrocarbon, fluorocarbon, liquid argon, water or similar dielectric liquid. Also, it will be understood that means are provided to pass current into and through the charge of chunks of material in the dielectric fluid. One such means of accomplishing this is described in greater detail below.

However, for the purposes of explanation and with reference to FIG. 3, the material 100 is an edge of a first chunk of such material and the body 102 is an edge of a second such chunk of material. The two chunks are separated by a body of dielectric 112 which before any current flows, extend uniformly through the region between the two confronting portions 100 and 102 of the respective first and second chunks. The gap between the respective chunk edges 100 and 102 is deemed to be relatively small and to be perhaps of he order of less than 50 microns. The gap is filled with the dielectric liquid 112 and the voltage applied to the first and second chunks permits a voltage of greater than 50 volts to be established across the gap. Under these conditions, the electric field E is equal to the voltage divided by the gap spacing. Also under these conditions, the electric field is high enough to enhance thermionic emission of electrons. These electrons are deemed to gain energy from the electric field and are deemed to be accelerated to ionize the dielectric liquid in the gap. As a result of the acceleration and ionization, more electrons and positive ions are produced in the gap. According to this mechanism, a plasma is formed in the gap very rapidly and in a time frame of less than 10 nanoseconds. Also, the plasma which is formed is deemed to have a temperature of greater than 10,000° Kelvin. The plasma is indicated in FIG. 3 as existing within the region 104 centrally located between the confronting portions 100 and 102 of the first and second chunks. The plasma in the region 104 is deemed to be surrounded by a vaporized dielectric illustrated as regions 110 above and below the plasma region 104. The vaporized dielectric region 110 is formed from vaporization of the dielectric 112 which had occupied all of the space between the chunks prior to formation of plasma.

From the description which is given, it will be recognized that there is formed, within a very short time frame, a very high temperature region within a closely confined volume and, as may be understood, such high temperature in a confined volume will result in a increased pressure and an estimate is made that the pressure may be in the range of about 2–30 bars.

With reference to FIG. 1, it will be understood that depending on how the electrodes 70 and 72 are connected to the power source either electrode 70 or 72 may be anode or cathode.

If we consider the case in which 70 is the anode and 72 is the cathode, it is evident that electrons go toward and to the anode 70 and positive ions go toward and to the cathode 72. The electrons move much more rapidly than the positive ions because the electrons are much lighter. For shorter pulses, the electrons are more effective in accomplishing spark erosion. For longer pulses, the ions are more effective. At higher voltages, the effective gaps between chunks can then be longer.

It will also be recognized that most of the heating of the charge of chunks of material will result from the transfer to the chunks of kinetic energy of the fast moving electrons or positive ions to a localized region of the confronting portions 100 and 102 of the adjacent first and second chunks. Such heating is extremely rapid and will occur at the confronting surfaces and is represented in FIG. 3 by the regions 106 and 108 showing molten material and by the material indicated as expelled as vapor or droplets into the plasma and with the passage of time into the vaporized dielectric and in turn into the dielectric itself.

As part of this explanatory description of suggested mechanism, it is presumed that the material in the regions 106 and 108 are raised to the boiling point of the material which is related to and associated with the high pressure within the plasma and its environment.

Also, the mechanism suggested here considers that while the plasma will be formed very rapidly, and in the order of less than 10 nanoseconds, that as the electric charge to the first and second chunks is dispelled that the spark between the confronting portions 100 and 102 wil collapse. Further, the mechanism suggests that as the plasma forms and as it is maintained by the flow of current, although these periods are extremely short, the pressure will be quite high and although melting will occur at the chunk surface, no ejection of material will take place. This collapse of plasma may be due, for example, to the discharge of a capacitor furnishing its charge to the first and second chunks, and the capacitor will just discharge to a point at which the voltage is lower than that required to maintain the plasma. However, on a localized basis, after the plasma collapses, the superheated regions 106 and 108 of the material will violently boil and cause an expulsion of vaporized and/or molten materials portions of the material as vapor or droplets which will then be rapidly cooled in turn by the dielectric 112 in the region between the confronting portions 100 and 102 of the first and second chunks which had been occupied by the plasma and vaporized dielectric. The vapor and droplets are thus moved very rapidly into and through the vaporized sheath and liquid dielectric and are therefore cooled very rapidly.

It will also be appreciated that if the duration of the spark is very short, that this brevity of the spark and plasma formation and collapse will reduce the amount of heat which diffuses away from the portion of the chunk which is in contact with the plasma. Because of this very short duration, the energy which is developed and expended in plasma formation and chunk melting and vaporization is confined to a small region at the surface of a chunk as illustrated, for example, by the regions 106 and 108 of the confronting portions 100 and 102 of chunks as illustrated in FIG. 3. Because the energy is confined to such a small region, this promotes very high heating in a small volume and accordingly favors the vaporization of the material over the formation of molten droplets. As the vaporized material is condensed by contact with the dielectric, smaller particles are formed. It is our conclusion and finding that in carrying out the process of the present invention the application of short pulses and the use of smaller capacitors with shorter time constants favors the formation of smaller particles.

Having now described a proposed mechanism for the action which occurs in carrying out the process of the present invention, description will be given now of a mechanism which has been found suitable for carrying out the process of the present invention and for the formation of fine particles from a great variety of materials.

Referring now first to FIG. 1, a jar container 10 is made up of a generally cylindrical body portion 12 and a cap 14 having a brim 16 at which the cap is seated on the body 12. The body 12 is shown in part in section with the uppermost portion 18 being left unsectioned.

The body 12 is made up of an upper and wider portion 20 and a lower portion 22 having a slightly smaller diameter than the upper portion 20. An electric discharge cell 26 rests on the internal surface of the rim 24 formed between the smaller diameter lower portion 22 and the larger diameter upper portion 20 of the body 12.

The container 10 is suspended from a cable 28 attached at plate 30. From the plate 30 three straps 32, 34 and 36 descend around the jar 10 and are attached by three end loops, two of which, 38 and 40, are shown mounted to hanger supports 42 and 44 formed integrally with the external wall of body portion 12.

Motion may be imparted to the jar 10 by means such as the motor 50, the shaft of which is linked eccentrically to one end of connecting arm 52. At its opposite end the arm 52 is attached to detent 54 by pivot pin 56. Detent 54 is in turn attached to strap 55 and strap 55 extends around the lower end of the upper part 20 of body 12. A bath of dielectric liquid 60 is contained within the lower half of the body portion 12 of jar 10 to a height to submerge an electric discharge cell 26.

An electric discharge cell 26 is illustrated and described in greater detail with reference to FIG. 2.

Figure 2:
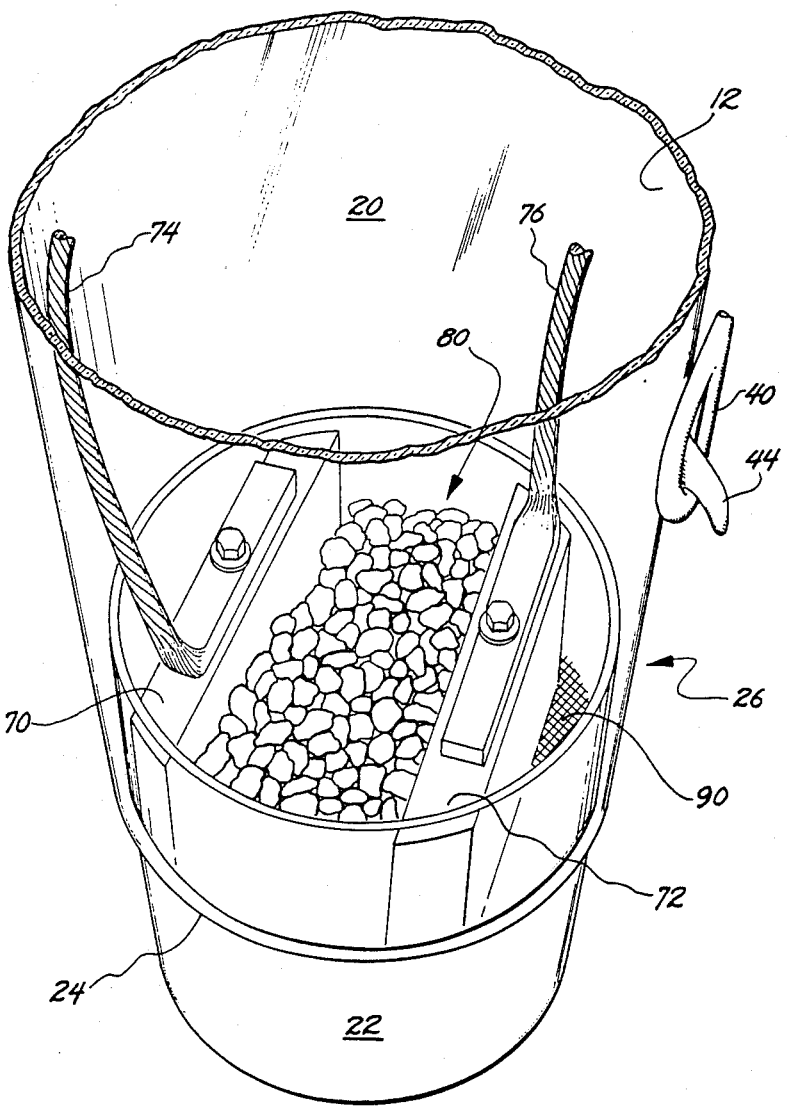
FIG. 2 is a perspective view, in part cut away, of greater details of the arrangement of electrodes and chunks from which the fine material may be prepared.

Referring now to FIG. 2, a broken-away view of the lower part of the jar 10 is illustrated in a perspective view. The jar wall of body portion 12 is shown in section and the external agitating means is omitted for the sake of clarity. An electric discharge cell 26 is shown to contain two electrodes 70 and 72. Pulsed surges of electric power are fed to these electrodes through the conductors 74 and 76.

Referring back again to FIG. 1, it is evident that the cable conductors 74 and 76 are connected through the wall of body portion 12 by conductive bolts 78 and 80 and, in turn, to the external conductors 82 and 84. Power supply means 86 provides power to these conductors 82 and 84 in a manner more fully described below. Supply 86 means contains a capacitor, and a voltage source for charging a capacitor, and these elements are arranged and connected to the cell 26 in a relaxation oscillator relationship. In other words, the capacitor discharges when it is charged to a high enough voltage to cause a spark or sparks to form within suitable gaps between chunks of charge 80.

Alternatively, a different type of power supply 26, as for example, a pulse generator which supplies pulses of power at a fixed frequency can and has been used. Charging and discharging the capacitor is repeated on a rapid cyclic basis to deliver a high rate of sparking pulses to the discharge cell.

Returning now once again to FIG. 2, the electric spark discharge cell 26 has a fine screen 90 at the bottom thereof. The screen is of a mesh such that fine particles produced by sparking between the chunks disposed between the electrodes will drop through the screen into a reservoir in the lower end 22 of the jar 10 to be recovered as fine particle product. The fine particles are generated as a result of sparking between numerous pairs of confronting surfaces of the chunks of material disposed as a body 80 between the two electrodes 70 and 72.

A manner in which such particles may be produced is illustrated diagrammatically in a conceptual representation of FIG. 3. In this figure, edge portions of two chunks 100 and 102 of material are shown in section. The edge portions are also shown to be separated in the sense that the confronting surface of the two chunks 100 and 102 would not touch if the spark between them were extinguished.

In one mode of practice of the present invention, a high voltage is discharged from a condenser in the power supply and is impressed for a short period through the electric leads 74 and 76 and this voltage is impressed also between electrodes 70 and 72. Electric power may be fed to power supply 86 from an external source not shown through conductors 94 and 96. The condenser discharge and recharge from a voltage source in power supply 86 is done on a repetitious basis so that voltage pulses are applied between the electrodes 70 and 72 and through the agitated body 80 of granular material. Such repetition may be, for example, between 10 and 500 times per second (depending, for example, on the time constant of the relaxation R-C circuit referred to above).

The impressed voltage causes sparking between the confronting surfaces of the spaced lumps of material disposed between the electrodes 70 and 72. For the apparatus of FIGS. 1 and 2, the spacing of the lumps may be brought about by the agitation of the contents of the electric discharge cell 26 by means of rod 52.

This combination of chunk agitation and high voltage discharge through the body of chunks immersed in the dielectric fluid provides a number of distinct advantages in the practice of the present invention. One advantage is referred to herein as a multiplier effect. By multiplier effect is meant that by combining the agitation and spark discharge, the electric power for the spark passes through several chunks strung along an electrical path between electrodes essentially in a circuitous line. As a consequence, there are simultaneous sparks between many of the pairs of confronting surfaces of the chunks in the body of material between the bar electrodes for each pulse of sparking power which is applied.

The spark repetition rate is high and may be about 100 applied spark impulses per second. For the apparatus of FIGS. 1 and 2, the principal agitation of body 80 may be continuous as the sparking voltage is repeatedly applied. We have also found that a body such as 80 of chunks can be at least partially agitated by the repeated generation of sparks. From the combination of these two coordinated actions, i.e., agitation and repetitious spark inducement, the number of interparticle sparks actually occurring is a multiple of the power surges applied to the electrodes and is quite high. The efficiency of production of fine particles as a result of such coordinated action is also quite high. Based on calculation from preliminary data, we calculate that at 400 volts and 50 micro Farads approximately 4000 particles are produced per pulse. At 400 volts and 150 $\mu$F calculation gives a particle production of 11,000 per pulse.

The spark, or very short duration arc, in the conceptual diagram of FIG. 3 is deemed to be typical of any one of the numerous essentially simultaneous sparks in the body 80. As explained above, it occurs in center region 104 between the spaced chunks and apparently forms a very brief plasma. This sparking action apparently also causes a melting of surface portion 106 and 108 respectively at chunks 100 and 102 of the material under treatment. While we are not entirely certain of the precise mechanism, we do know from results obtained that sparking also causes a detachment of tiny particles from apparently molten microsurfaces 106 and 108 of chunk portions 100 and 102. These tiny particles are found in the dielectric liquid and are thus deemed to be freed by the spark plasma to move out of and away from the melt and into a vapor region 110 and into a dielectric fluid which may be an organic solvent. As indicated above, the liquid dielectric 112 is illustrated in the conceptual rendering above and below the vapor regions 110 and it is this fluid which becomes blackened with a cloud of the fine particles as the sparking is carried out.

As illustrated in FIG. 1, the spark chamber of cell 26 is filled with dielectric liquid 60 and the liquid also fills the collection chamber 22 beneath the spark chamber. This liquid quickly becomes clouded with the fine particles soon after the spark erosion process is started. It is also evident from FIG. 1 that the spark chamber of cell 26 is disposed above screen 90 stretched across the bottom of the chamber. Screen 90 is supported at the bottom of the container by an insulating grid work 92. Particles formed within the chamber may pass through screen 90 and, in turn, through grid 92. The movement of fine particles formed between the chunks down among the chunks and through the screen 90 and grid 92 is aided by the agitation of the cell jar 10, and of cell 26 within jar 10, by the agitating arm 52 as described above. This agitation also aids in avoiding formation of welds between chunks of body 80 and also between the chunks which bear on the surfaces of electrodes 70 and 72 and the electrode surfaces.

Employing the apparatus, as described above and as illustrated in FIGS. 1 and 2, the process of the present can be carried out with a very wide range of materials by the spark erosion phenomena. The materials which can be spark eroded are essentially any material in chunk form through which an applied voltage can be passed to generate the multiple chain of sparks between the particles to cause the erosion. Generally this will depend on the nature of the material and the strength of the sparking voltage which is applied to a body of the chunks to form a pulse on a repetitious basis. In order for the sparking phenomena to effectively produce the particles, as taught in this invention, the material in the bulk form must have a certain maximum resistivity. We have found that chunks of material in a body immersed in a dielectric fluid, which has a resistivity less than approximately $10^{-3}$ ohm centimeters, is suitable for carrying out the process of the present invention.

We have found no limit on the melting temperature of the material, and materials which melt at temperatures over 3000° C. may be spark eroded by the process of this invention.

Further, as is evident from the above description of the apparatus, suitable apparatus can be formed of glass. For materials which have extremely high melting points and which are highly reactive such as, for example titanium metal, there is no problem of reaction between the material being subjected to spark erosion and the apparatus. This is in sharp contrast of course to other processes, as for example it is known that titanium metal reacts with essentially any crucible material when in the molten state and that such reactions of the material to be atomized with the container is a serious consideration in many prior art methods for atomization. However, the subject process of atomization through spark erosion is not subject to the limitations that are imposed by container materials, such as crucibles on the processing of the material.

Further, we have found that some dielectric materials do tend to undergo reactions as part of the spark erosion process but we have also found that the number of dielectric liquids which can be employed is extremely large. We have found that for essentially any material to be spark erosion atomized, a non-reacting dielectric liquid can be employed which avoids such reactions. One such very, very inert dielectric liquid is liquid argon. It is noteworthy that the process of the present invention can be carried out in dielectric liquid at essentially any temperature including temperatures of liquid gas such as liquid nitrogen or liquid argon.

One parameter which must be carefully considered in the processing of material in accordance with the present invention is the nature of the starting material itself. Generally, because the particles which are produced are of such extremely small size, it is desirable that the starting material have a degree of homogeneity which is at least of the order of the particle size to be prepared. For example, in the case of multiphase alloys, it is known that these alloys do have regions of single phase, or grains which may vary in size dependent on the method of preparation and the method of treatment, as for example heat treatment, as certain heat treatments can enlarge the grain size of such alloy materials. In the practice of the subject invention, it is desirable that the grain size of such multiphase alloys, which are used as a charge as well as electrodes in the manner described above, be small. It is preferred that such grain size be smaller than the particle size to be prepared pursuant to the process. This precaution is a parameter which enhances the homogeneity of the content of the individual particles which are formed pursuant to the process. Another way in which homogeneity of product particles can be enhanced is by enlarging the melt pool, 106 or 108 as illustrated in FIG. 3, from which particles are generated. This is accomplished by increasing the power applied per pulse. Desirably, the power conditions should be such that the melt pool or zone from which particles are formed should include several grains of the starting material. At the higher power, each of these grains may be larger than the particles to be formed. Depending on grain size, a whole region of larger grains may be melted at higher power and result in significant mixing of the ingredients of several grains prior to particle ejection.

Where other materials do not have a sufficient degree of homogeneity or sufficiently small grain size, then some treatment, as by comminution and consolidation or rapid solidification as by melt spinning and consolidation, may overcome this limitation of the starting material and permit desirable, uniform distribution of the ingredients of the alloy into the particles to be achieved.

We have further found that the preparation of finely divided material by the spark erosion process of the subject invention favors a more efficient production of smaller particles than is found to be the case with other atomization techniques, as for example atomization from a molten state coupled with interaction with a flowing fluid, such as a gas or a liquid.

We have successfully spark erosion atomized alloys to form very finely divided particles through the process as described above in using apparatuses also described above with respect to the FIGS. 1 and 2. From this work, we have determined that greater than 40% of the product has a particle size of less than 20 microns where the processing is according to average control of parameters and without any particular efforts directed toward emphasizing the production of smaller particles. As has been noted above, the parameters employed in practicing the subject invention can be altered to emphasize the production of smaller sized particles and this, as indicated above, can be accomplished in one respect by shortening the period of the spark or duration of the pulse of electric energy which is delivered to the charge within a discharge chamber, such as 26 of FIG. 1. Remarkably, we have even produced nickel-based particles in which all, that is 100%, of the particles are of less than 5 microns.

To our knowledge, there is no other widely applicable process which is capable of generating these very high percentages of very fine particles and, in this respect, the subject invention and the method and apparatus by which it is carried out is unique in producing such surprising and unexpected results. Also, it should be realized that the efforts to produce smaller size particles are with a limited amount of effort and at an experimental stage of development and that we believe that the process and apparatus taught in the subject invention is capable of producing greater yields of finer particles than have been found to result from these early efforts.

We have also determined that because of the very high temperature generated within the very small space occupied by the spark and plasma and because of the short duration of the spark that the spark erosion process of the subject invention produces particles at a more rapid solidification rate than any other process known to the applicants. It is known that rapid solidification, as is accomplished through the practice of the present invention, is useful and advantageous when small grain size is sought in the particles formed or amorphous structures are desired, as for example for enhancement of mechanical or electrical properties or for rapid diffusion bonding during consolidation in powder metallurgical applications.

Another important advantage in preparation of materials through the practice of the present invention is the very high temperature of the spark plasma which induces formation of the fine particles. It is the very high temperature of the plasma which makes it possible to spark erode atomize materials regardless of their melting point. In addition, any plasma region must contain electrons and ions resulting from the breakdown of the dielectric liquid. By the present process, advantage can be taken of the presence of such ions in inducing reactions between the charge material and the decomposition products of the dielectric. In this way, it has been found possible to produce oxides and carbides of charge material, such as metals.

It is pointed out above in describing the apparatus in which the subject process can be carried out, that the power supply 86 may contain a capacitor and a means for charging the capacitor and permitting it to discharge to the electrodes 70 and 72 and from the electrodes through the charge 80 of chunks of material within the electric discharge cell 26. If the capacitor is charged and then discharges to the electrodes 72 and 70 and through the charge 80 of chunks of material in the electric discharge cell 26, it may be found that there may be a flow of current through the charge 80 without the production of sparks. In such case, only heat will result from the passage of the current through the charge 80 and particles will not be produced. In effect, this is a shorting of the cell and the power supply and capacitor will discharge through the cell in a non-productive fashion. An important aspect of the practice of the present invention is the inducement of gaps between the chunks and particularly gaps which are filled with the dielectric medium in which the chunks are immersed. As indicated above, one simple way in which such gaps may be produced is by the agitation of the charge 80 of chunks within a cell. However, it will also be realized that if the separation between the chunks of material is too large, that no breakdown will occur in the dielectric medium between confronting portions of the chunks and no useful spark or plasma will occur in such manner that particles can be formed.

Rather, it will be understood that it is the development of gaps and particularly gaps within a size range which permits the electric discharge to create sparks and plasmas so that useful sparking will occur and particles will be formed. In other words, the agitation of the charge, such as 80, is one parameter which is important to the practice of the present invention and this parameter may be related to the development of gaps within a useful range for generation of sparks for the applied voltage and current. The applicants have demonstrated that the agitation of a charge, such as 80, within a cell as described above, does produce valuable and useful sparking and plasma and results in the electric power passing through a string of particles at their respective confronting surfaces to produce finely divided particles as explained more fully above. Accordingly, with the knowledge that these phenomena are feasible, it will be understood that the parameter of gap size and degree of agitation are parameters which can be studied by those skilled in the art to find relationships between the agitation of a charge, such as 80, and the application of electric energy to optimize the production of particles. Further, such study can further be employed, as indicated above, to optimize the production of particles of a preferred size range, as for example smaller size particles in larger concentration. As indicated above, we have found that the use of smaller capacitors which provide more frequent pulses from the R-C relaxation circuit forces the production of smaller particles.

Another parameter which is significant in the practice of the invention concerns the characteristic physical characteristics of the chunks of a charge, such as 80 of FIG. 1. We have observed that when the chunks are generally flat in configuration rather than being of largely random shape, a considerable background current is noted. Background current here refers to a passage of current through the cell from electrode to electrode without the production of sparks and resultant fine particles. For this reason, it is highly preferred to have very random shaped chunks. It is noted that as a charge of chunks is progressively electric discharge atomized, the sharper edges tend to disappear and the chunks assume more rounded surfaces. Such rounded surfaces are conducive to the continuation of the efficient operation of the process.

What is to be avoided is large area confronting regions of chunks which have equal potential regions. Such areas do not induce the formation of sparks. It is understood that the presence of sharp, high potential points is more conducive to the formation of the sparks. For this reason, the initial use of random shaped particles or chunks such as is produced by mechanical subdivision of a material is preferred. Such processing when combined with the subject process can result in lower costs of production of fine particles of relatively homogeneous composition.

Where the large area equal potential regions are found in the chunks, we observed a tendency toward the formation of a diffuse arc rather than the sharp spark-type discharge. An arc is a more diffused discharge which is less localized and thus less efficient in particle production. This may be because the average temperature may be too low to produce melting or vaporization.

Such arcing may also occur if a cell is shorted by the application of the capacitor discharge and the cell is agitated to induce sparking but the capacitor is partially discharged when conditions in the cell are proper for production of sparks from a fully charged capacitor.

It is known that boron-doped silicon-germanium alloys are employed in thermoelectric devices. Such devices are well known in the art and may employ phosphorous doped silicon-germanium and boron-doped silicon-germanium in combinations of various physical configurations to form thermocouple devices, i.e. devices which generate an electric current flow when heated. Such devices may be employed in generation of electric power by use of the thermoelectric silicon-germanium structures in association with heat sources.

It is also known that the efficiency of operation of the silicon-germanium devices depends, at least in part, on the degree of homogeneity of distribution of the silicon and germanium in the electric generating portion of the devices.

When a melt of boron-doped silicon-germanium is cast into a bar, as by chill casting, there is a tendency for the silicon and germanium to segregate into different crystalline formations. In other words, the normal phenomenon of solidifying from the melt causes portions of crystals to form which are primarily silicon and other portions to form which are primarily germanium. Typical grain structure of a chill cast alloy illustrating the crystal form for a boron-doped composition of 78 silicon-germanium is provided in FIG. 4. Such a composition is a typical starting material in the Examples which follow.

Because of this natural phenomenon which accompanies casting, and because of the need in thermoelectric devices for greater intimacy of contact of the ingredients of the materials, a practice has been followed in the industry of breaking up cast silicon-germanium. By this practice, the cast bars are first broken into chunks and the chunks are then ground to as fine a state of subdivision as the technique permits. After being ground, the finely divided material is pressed and sintered to form a compact. The compact is then sliced mechanically to form elements from which thermoelectric devices can be fabricated.

One real problem in use of this technology in forming thermoelectric devices is that grinding does not permit an extremely fine degree of subdivision of the silicon-germanium. Also, the distribution of the silicon and germanium within the ground particles which are formed is not as homogeneous as is desired and is in fact not greatly different than the distribution of these two elements in the starting material. In other words, the starting material does not have a homogeneous microstructure. The conventional product is improved over the starting material but its microstructure is far from homogeneous. What is gained by this grinding procedure is to bring the surface of a particle which may have a high proportion of silicon into contact with a particle which may have a high proportion of germanium. The improvement in microstructure which can be achieved in this way is limited.

There is, however, no redistribution of the silicon and germanium within a single particle as a result of the grinding. However, by means of the subject invention, such redistribution within a single particle is accomplished. A far greater improvement in the homogeneity of the microstructure is made possible.

EXAMPLE 1

Figure 4:
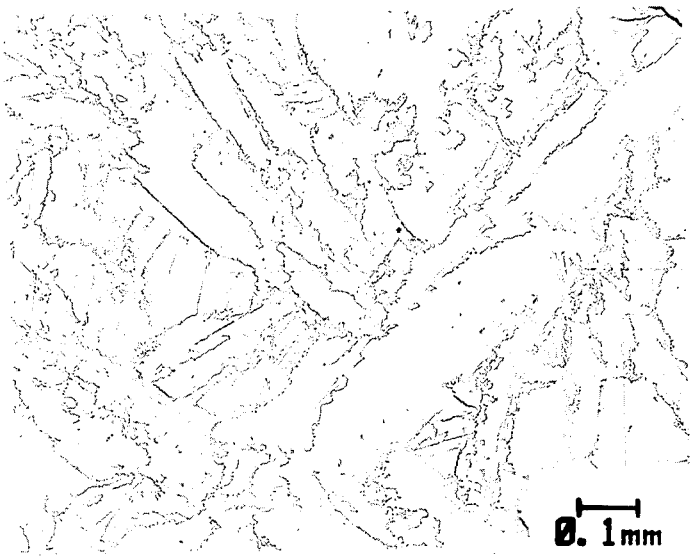
FIGS. 4 through 9 are photomicrographs of various particles and structures of silicon germanium formed by the present invention.

A powder was formed by first crushing a chill cast alloy of boron-doped silicon-germanium containing 78 atomic percent silicon. The chill-cast material was formed in bars of about ½ inch diameter and the mold in which the casting was made was a metal mold to accelerate the rate of solidification. The chunks used in the electrical processing were prepared by breaking chill-cast bar by conventional hammer and tong processing. The chill cast alloy was crushed to roughly several millimeter sized chunks. A micrograph of the 78 silicon-germanium taken at a magnification of 100× is shown in FIG. 4. In this Figure, discrete crystalline zones of silicon and other discrete crystalline zones of germanium are evident. This crystalline form is typical of what is found in chill cast bar and in such bar which has been crushed to granules. The crushings were placed in the spark chamber or cell 26 over the fine mesh screen 90, which may be a 100 mesh nylon screen, for example. The container was filled with dodecane to a level as illustrated in FIG. 1 by liquid 60. Electrodes formed from chill cast bars of boron-doped 78 silicon-germanium were placed on the screen as shown at 70 and 72 in FIG. 1 on opposite sides of cell 26. The crushings or chunks were placed as a body 80 as shown in FIG. 2 between the electrodes 70 and 72.

The motor 50 was turned on to agitate jar 10 and its contents and repetitive voltage pulses were applied to the electrodes 70 and 72 through the conductors 74 and 76. This caused sparking among the chunks of the doped silicon-germanium which were disposed between the electrodes and sparking between the chunks and the electrodes.

The sparks caused the removal, by local melting or by vaporization, as explained above, of small regions from confronting surfaces of the silicon-germanium chunks. Particles formed on freezing of the molten and vaporized material, and the particles passed through the screen at the bottom of the cell 26 due in part to the agitation of the jar 10.

The chunk material underwent spark erosion well and produced about 3 cubic centimeters of powder within a three-hour time span. The particles were predominantly less than about 30 microns in diameter.

It will be understood that the particles produced by the sparking result from the melting and vaporization of the material of the chunks. Also, the particles which are formed from the vapor or melt are very rapidly solidified. Based on these combination of phenomena a redistribution of the silicon and germanium within the product particles is accomplished.

It is within the scope of the present invention to develop particles with better homogeneity of microstructure and better thermo-electric properties by spark erosion in an organic dielectric or cryogenic or liquified gas dielectric medium.

EXAMPLE 2

In this example the procedures of the example above were repeated. However, in this example the electrodes employed were tungsten metal electrodes. For sparking between particles, the tungsten electrodes do not make any significant difference in carrying out the subject method.

The charge of particles disposed between the electrodes was chill-cast boron-doped silicon-germanium containing 78 atomic % silicon and the balance germanium. The size of the chunks were approximately 5 mm average diameter, as a rough average.

Figure 5:
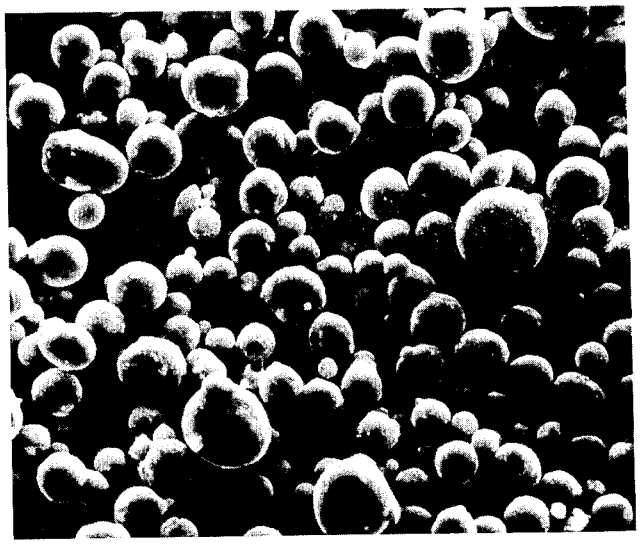

The particles were formed as described in Example 1. About 3 cubic centimeters of powder were collected within a three hour time span. The particles formed were less than 30μ in diameter. FIG. 5 is a scanning electron micrograph of some of the collected boron-doped 78 silicon-germanium particles.

Figure 6:
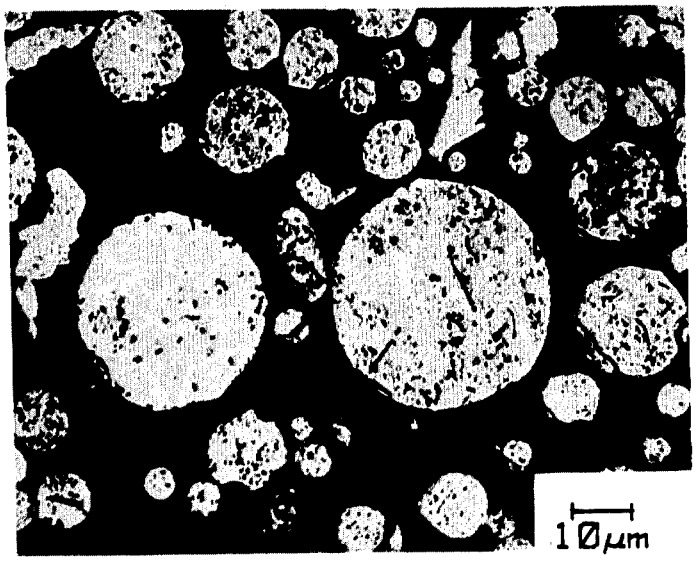

The microstructures of the cross-section of some spark eroded particles at a magnification of 500× are displayed in FIG. 6. With reference now to the respective FIGS. 4 and 6 it is evident that in each of these figures grain structure is shown. It is also evident that the microstructure of the grain structure of the FIG. 6 structure is much finer than that of the FIG. 4 structure. This is evident in part by a direct comparison of the content of the figures. Some of the individual grains of crystal of the FIG. 4 structure are longer than the largest diameter particle of the FIG. 6 structure. Moreover, it will also be appreciated that the FIG. 6 structure is shown at a magnification of 500× while that of FIG. 4 is shown at a magnification of 100×. In fact, the section of some entire particles of FIG. 6 are smaller than the section of some of the individual grains of FIG. 4. Accordingly, it is quite evident that a remarkable degree of improvement in homogeneity of microstructure is achieved through practice of the present invention.

EXAMPLE 3

A sample of chill cast bar of boron-doped 78 silicon-germanium was crushed and ground by conventional means. After grinding, the particles formed were consolidated by heating and pressing, again by conventional means. The consolidated specimen had the shape of a hockey puck. It was cut to remove two electrode-size pieces and the remainder of the puck was fractured into small chunks.

Figure 7:
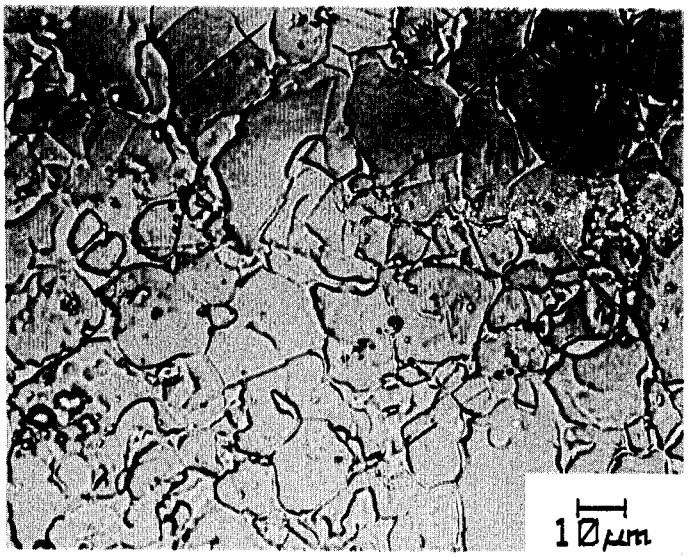

A micrograph of one of the chunks was made and is included here as FIG. 7. The photomicrograph shows the grain structure of a sample prepared by conventional means.

Figure 8:
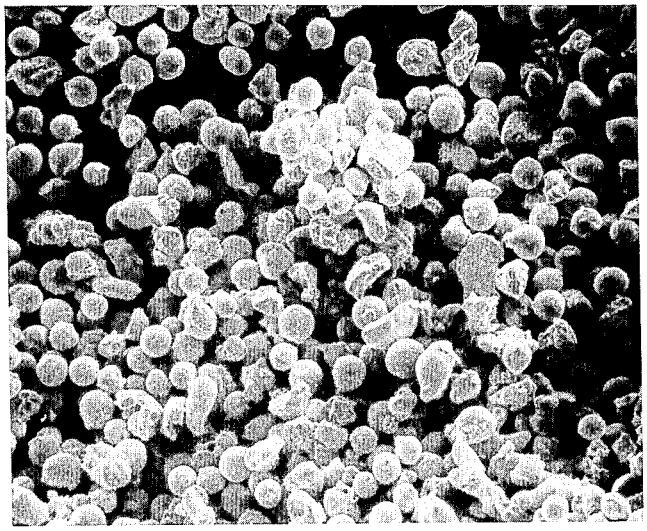

The chunks were subjected to spark discharge treatment in dodecane dielectric as described above. Particles formed from this treatment are silicon in FIG. 8 at a magnification of 200×.

Some of the particles were mounted and polished to show the microstructure within the particles as was done in Example 1. Photomicrographs of the sectioned particles is provided as FIG. 9 at a magnification of 1000×.

Figure 9:
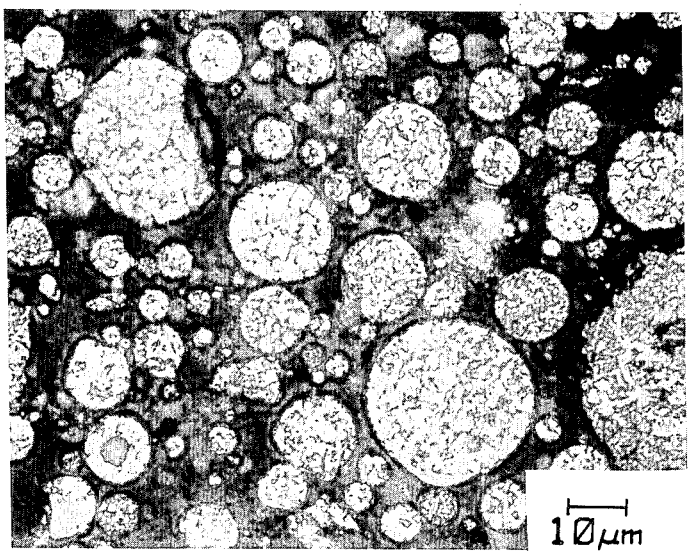

The great gain achieved in homogeneity of microstructure is evident by comparing the microstructure of the ground and sintered sample of FIG. 7 with the microstructure of the spark eroded particles of FIG. 9.

In the foregoing examples, dodecane was used as the dielectric liquid. Because of the organic nature of dodecane it is possible that some slight amount of carbon might be introduced into the product of the spark erosion process. To overcome this potential problem, we have used a more inert dielectric liquid such as liquid nitrogen or liquid argon.

One way in which the distribution of the silicon and germanium can be further optimized is by casting a melt of silicon-germanium in the form of a rapidly solidified ribbon. Such casting is by the known technique by which amorphous metals are formed. In general, this involves forming a thin ribbon-like stream of the melt and causing the stream to contact the flat outer surface of a rotating metal disc. It is the very rapid solidification of the melt which causes the solid ribbon to form in the amorphous state. Once such ribbon is formed of the silicon-germanium, it is used as the feed stock for the spark erosion process as described above. This feed stock may either be in ribbon form or preferably in a compacted form. For example, compaction by explosive forming may be employed.

The advantage of using such a source material is that the proportion of silicon to germanium i.e., 78 silicon-germanium in the above examples, is held constant by the rapid solidification to ribbon form. There is a significant likelihood that the spark eroded product will be in the specified ratio if the starting material is in the specified ratio to begin with.

From the foregoing, it is evident that the subject invention provides an effective means for production of extremely fine powder from a variety of starting materials.

The spark erosion process of the present invention can be adapted to an economically large scale production process. In the relatively small cell which is described with reference to FIGS. 1 and 2, the lateral cell dimensions were about 3" by 3". In the cell of such dimensions, we were able to produce one pound per hour of iron-based powder having average particle size of less than 75 microns. This production of one pound per hour was accomplished at an electrical consumption rate of about 3 kilowatt hours per pound. For a kilowatt hour cost of about 8 cents, the cost per pound of the electrical power consumed was about 25 cents. However, it will be realized that such production is with respect to a limited cell of limited dimensions and limited control of the parameters which are known to be important to the optimization of the process.

We estimate that a conservative estimate of the electrical costs of producing the particles by the spark erosion process, the cooling of the dielectric fluid in which the spark erosion process is carried out and the pumping of the slurries of material and particularly the finer particle material which is formed is in the range of about 50 cents per pound.

The estimates given here are based on preliminary studies and are in this respect deemed to be quite conservative. What has been identified are the important parameters and these parameters are studied involving the yield, size distribution, efficiency and other factors and parameters concerning the process.

Another factor which enhances the operability and efficiency of the process is that the powders are produced in a liquid. Because they are produced in a liquid, classification of the powders according to size can be facilitated and simplified. One reason is that the particle agglomeration while the powders are in a liquid is minimized. Such agglomeration can be further reduced by addition of surfactants. The simplification is made possible where the powder is in a liquid medium because the product can be pumped through a filtration system, settling tanks or other classification apparatus.

Concerning now the power sources for use in supplying power to the spark erosion atomization apparatus, as for example the power supply 86. The power supply employing a capacitor and means for charging the capacitor and also means for periodically discharging the capacitor through the charge 80 in the apparatus is the relaxation oscillator type of apparatus which has been used most frequently as our power source in experiments which are reported. However, it will be understood that other power sources may be used and others have been used in carrying out the spark erosion atomization process.

One such alternate source of power is the use of pulse generators manufactured by Velonex. These instruments consist of a basic primary pulse unit to which one connects secondary plug-ins of various types to produce pulse transformers capable of covering a wide range of pulse widths, amplitudes and frequencies. It is through the use of these pulse generators that we were able to determine the influence of pulse widths on particle size distribution.

The pulse transformers and the relaxation oscillators which have been employed have operated on a rather low duty cycle of perhaps a few percent. However, it is feasible to employ a DC power source with a maximum power rating of 300 volts at 200 amps. Such a source has transistor switches which permit variable pulse width, frequency and hence enhanced duty cycle. With this flexibility, a greater variation in the parameters which govern yield and distribution of particle sizes is feasible.

The foregoing presents a recitation of numerous important factors which bear on the definition and teaching of the invention of the subject application. It will be understood that with the teaching which has been provided those skilled in the art will be able to make effective use of the invention in producing powder of very fine size and of desired particle size. With this teaching, other variations can be made in the parameters which have been taught above to be important in controlling the production and the yield and efficiency of the process described.

What is claimed and sought to be protected by Letters Patent of the United States is as follows:

1. The method of forming a thermoelectric device from a silicon-germanium casting which comprises casting the silicon-germainium composition, breaking up the casting into small chunks, disposing the chunks as a body in a liquid dielectric in a spark chamber, agitating the body of chunks to cause momentary separation therebetween, impressing a sparking voltage on and through said body to cause momentary melting at the surface of said chunks and formation of rapidly solidified particles of silicon-germanium composition therefrom, consolidating the formed particles to form a compact, and mechanically slicing the compact into thermoelectric elements.

2. The method of claim 1 wherein the atomic percentage of silicon in the silicon germanium casting is 78 atomic percent.

3. The method of claim 1 wherein the particles formed have diameters of less than 30 $\mu$.

4. The method of claim 1 in which the silicon-germanium which is subjected to spark erosion has been rapidly solidified to ribbon.

* * * * *